US007028687B1

(12) United States Patent
Silver et al.

(10) Patent No.: US 7,028,687 B1
(45) Date of Patent: Apr. 18, 2006

(54) ESCAPE HOOD

(75) Inventors: Mitchel Silver, New York, NY (US); Harlan S. Berger, New York, NY (US)

(73) Assignee: Precious Life, LLC, New York, NY (US)

( * ) Notice: Subject to any disclaimer, the term of this patent is extended or adjusted under 35 U.S.C. 154(b) by 0 days.

(21) Appl. No.: 10/744,979

(22) Filed: Dec. 22, 2003

Related U.S. Application Data

(63) Continuation-in-part of application No. 10/244,714, filed on Sep. 16, 2002, now Pat. No. 6,701,919, which is a continuation of application No. 09/383,675, filed on Aug. 26, 1999, now Pat. No. 6,450,165.

(51) Int. Cl.
*A62B 17/04* (2006.01)
*A62B 18/00* (2006.01)
*A62B 19/00* (2006.01)
*A62B 17/00* (2006.01)
*A62B 9/00* (2006.01)

(52) U.S. Cl. ..... 128/201.22; 128/201.23; 128/201.24; 128/201.25; 128/201.28; 128/201.29; 128/202.11; 128/205.23; 220/500; 220/502; 220/554

(58) Field of Classification Search ..... 128/201.22, 128/201.23, 201.24, 201.25, 201.28, 201.29, 128/202.11, 205.23; 220/500, 502, 554
See application file for complete search history.

(56) References Cited

U.S. PATENT DOCUMENTS 682,455 A * 9/1901 Cooper ..... 128/201.25
2,339,627 A * 1/1944 Edison ..... 312/199
2,575,567 A * 11/1951 Swartz ..... 312/304
2,831,607 A * 4/1958 Berndt ..... 222/3
3,500,033 A 3/1970 Cole et al.
3,597,362 A 8/1971 Bollyky et al.
3,638,258 A 2/1972 Black
3,691,085 A 9/1972 Roberts et al.
3,704,231 A 11/1972 Bollyky
3,749,679 A 7/1973 Rauhut
3,775,366 A 11/1973 Wolff et al.
3,816,326 A 6/1974 Bollyky
3,888,786 A 6/1975 Maulding
3,895,625 A * 7/1975 Delest ..... 128/201.25
3,904,605 A 9/1975 Baker
3,940,604 A 2/1976 Rauhut
3,940,905 A 3/1976 Perry
3,950,158 A 4/1976 Gossett
3,974,368 A 8/1976 Rauhut
3,977,202 A 8/1976 Forusz et al.

(Continued)

*Primary Examiner*—Henry Bennett
*Assistant Examiner*—Nihir Patel
(74) *Attorney, Agent, or Firm*—Milde & Hoffberg LLP

(57) ABSTRACT

An escape hood, comprising a respirator, having an air filter suitable for filtering toxic air contaminants and positioning members to retain the respirator in a respiratory path of the user; an optical lens; a expanding member, permitting hood to expand from a compact storage configuration to a usage configuration; a sealing structure, around said air filter, for preserving said filter during storage; and an unsealing mechanism, adapted to allow a user to withdraw the escape hood from a storage vessel, wherein during withdrawal, said sealing structure is automatically unsealed. An escape hood system is also provided, comprising: an array of storage vessels, each vessel being adapted to receive a sealed escape hood; a retainer, for retaining a sealed escape hood within the vessel, wherein the escape hood is unsealed during withdrawal of the escape hood from a storage vessel; and an electronic sensor for determining an occupancy of a storage vessel.

24 Claims, 13 Drawing Sheets

U.S. PATENT DOCUMENTS

| | | | | | |
|---|---|---|---|---|---|
| 4,010,620 | A | | 3/1977 | Telkes | |
| 4,064,428 | A | | 12/1977 | VanZandt | |
| 4,076,645 | A | | 2/1978 | Vega | |
| 4,081,256 | A | | 3/1978 | Donnelly | |
| 4,116,237 | A | * | 9/1978 | Birch | 128/201.19 |
| 4,173,220 | A | * | 11/1979 | Ratz et al. | 128/201.19 |
| 4,186,426 | A | | 1/1980 | Gingras et al. | |
| 4,231,359 | A | * | 11/1980 | Martin | 128/201.18 |
| 4,236,514 | A | | 12/1980 | Moretti | |
| 4,313,843 | A | | 2/1982 | Bollyky et al. | |
| 4,379,320 | A | | 4/1983 | Mohan et al. | |
| 4,382,440 | A | | 5/1983 | Kapp et al. | |
| 4,382,446 | A | | 5/1983 | Truelock et al. | |
| 4,427,010 | A | | 1/1984 | Marx | |
| 4,467,795 | A | * | 8/1984 | Eckstein | 128/201.25 |
| 4,508,642 | A | | 4/1985 | World | |
| 4,626,383 | A | | 12/1986 | Richter et al. | |
| 4,627,431 | A | * | 12/1986 | Werjefelt | 128/201.25 |
| 4,678,608 | A | | 7/1987 | Dugliss | |
| 4,683,880 | A | * | 8/1987 | Werjefelt | 128/201.28 |
| 4,698,183 | A | | 10/1987 | Koroscil | |
| 4,710,756 | A | * | 12/1987 | Thornburg et al. | 340/628 |
| 4,717,511 | A | | 1/1988 | Koroscil | |
| 4,745,922 | A | | 5/1988 | Taylor | |
| 4,751,119 | A | | 6/1988 | Yukawa | |
| 4,751,616 | A | | 6/1988 | Smithey | |
| 4,780,117 | A | | 10/1988 | Lahey et al. | |
| 4,784,803 | A | | 11/1988 | Borsotti | |
| 4,840,171 | A | * | 6/1989 | Rohling et al. | 128/204.18 |
| 4,905,684 | A | * | 3/1990 | Heffer | 128/202.13 |
| 4,920,963 | A | | 5/1990 | Brader | |
| 4,950,588 | A | | 8/1990 | Dattagupta | |
| 4,967,573 | A | | 11/1990 | Wilhelm | |
| 4,986,076 | A | | 1/1991 | Kirk et al. | |
| 4,996,982 | A | * | 3/1991 | Williamson | 128/205.24 |
| 5,003,973 | A | | 4/1991 | Ford et al. | |
| 5,113,527 | A | | 5/1992 | Robertson-McKenzie | |
| 5,113,854 | A | * | 5/1992 | Dosch et al. | 128/201.23 |
| 5,115,804 | A | * | 5/1992 | Brookman | 128/201.22 |
| 5,119,808 | A | * | 6/1992 | Marquardt et al. | 128/201.22 |
| 5,122,306 | A | | 6/1992 | VanMoer et al. | |
| 5,133,344 | A | | 7/1992 | Jurrius et al. | |
| 5,146,636 | A | | 9/1992 | DeLaPena | |
| 5,158,349 | A | | 10/1992 | Holland et al. | |
| 5,201,365 | A | | 4/1993 | Siegel | |
| 5,226,409 | A | | 7/1993 | Bower et al. | |
| 5,226,710 | A | | 7/1993 | Giglia et al. | |
| 5,232,635 | A | | 8/1993 | VanMoer et al. | |
| 5,239,989 | A | * | 8/1993 | Chen | 128/200.24 |
| 5,261,241 | A | | 11/1993 | Kitahara et al. | |
| 5,281,367 | A | | 1/1994 | Schleck et al. | |
| 5,283,911 | A | | 2/1994 | DeMars | |
| 5,294,377 | A | | 3/1994 | Chopdekar et al. | |
| 5,309,571 | A | * | 5/1994 | Huang | 2/458 |
| 5,323,492 | A | | 6/1994 | DeMars | |
| 5,367,706 | A | | 11/1994 | Davidson | |
| 5,370,828 | A | | 12/1994 | Ladyjensky | |
| 5,388,570 | A | * | 2/1995 | Wassil | 128/200.24 |
| 5,390,086 | A | | 2/1995 | Holland | |
| 5,419,450 | A | * | 5/1995 | Guglielmelli et al. | 220/255 |
| 5,421,326 | A | | 6/1995 | Rankin et al. | |
| 5,431,022 | A | | 7/1995 | Abe | |
| 5,431,156 | A | | 7/1995 | Sundstrom | |
| RE35,007 | E | | 8/1995 | Cohen et al. | |
| 5,451,347 | A | | 9/1995 | Akhavan-Tafti et al. | |
| 5,452,712 | A | | 9/1995 | Richardson | |
| RE35,132 | E | | 12/1995 | Bay et al. | |
| 5,483,956 | A | * | 1/1996 | Shapiro | 128/206.27 |
| 5,484,556 | A | | 1/1996 | Akhavan-Tafti et al. | |
| 5,488,544 | A | | 1/1996 | Ladyjensky | |
| 5,495,847 | A | * | 3/1996 | Hu | 128/202.26 |
| 5,508,893 | A | | 4/1996 | Nowak et al. | |
| 5,536,195 | A | | 7/1996 | Stamos | |
| 5,543,524 | A | | 8/1996 | Mattingly et al. | |
| 5,545,739 | A | | 8/1996 | Mattingly et al. | |
| 5,552,968 | A | | 9/1996 | Ladyjensky | |
| 5,576,212 | A | | 11/1996 | Honzawa et al. | |
| 5,597,517 | A | | 1/1997 | Chopdekar et al. | |
| 5,603,729 | A | | 2/1997 | Brown et al. | |
| 5,609,509 | A | | 3/1997 | Stamos | |
| 5,650,099 | A | | 7/1997 | Akhavan-Tafti et al. | |
| 5,655,525 | A | * | 8/1997 | Orr | 128/205.25 |
| 5,690,095 | A | * | 11/1997 | Glynn et al. | 128/201.23 |
| 5,705,103 | A | | 1/1998 | Chopdekar et al. | |
| 5,724,958 | A | * | 3/1998 | Farnworth et al. | 128/201.23 |
| 5,792,213 | A | | 8/1998 | Bowen | |
| 5,820,530 | A | * | 10/1998 | Kallassy | 482/111 |
| 5,824,242 | A | | 10/1998 | Ladyjensky | |
| 5,839,432 | A | * | 11/1998 | Daneshvar | 128/201.25 |
| 5,845,640 | A | | 12/1998 | Lawandy | |
| 5,875,775 | A | | 3/1999 | Nur et al. | |
| 5,931,383 | A | | 8/1999 | Palmer et al. | |
| 5,941,093 | A | | 8/1999 | Bengt | |
| 5,967,308 | A | | 10/1999 | Bowen | |
| 6,012,175 | A | | 1/2000 | Johnston | |
| 6,017,606 | A | | 1/2000 | Sage et al. | |
| 6,036,004 | A | | 3/2000 | Bowen | |
| 6,065,847 | A | | 5/2000 | Palmer et al. | |
| 6,099,555 | A | | 8/2000 | Sabin | |
| 6,103,280 | A | | 8/2000 | Molzahn et al. | |
| 6,106,129 | A | | 8/2000 | Cranor et al. | |
| D431,934 | S | * | 10/2000 | Chininis | D6/446 |
| 6,126,871 | A | | 10/2000 | Cranor | |
| 6,141,970 | A | | 11/2000 | Molzahn et al. | |
| 6,151,536 | A | * | 11/2000 | Arnold et al. | 700/237 |
| 6,230,501 | B1 | | 5/2001 | Bailey et al. | |
| 6,267,914 | B1 | | 7/2001 | Cranor | |
| 6,409,746 | B1 | | 6/2002 | Igaki et al. | |
| 6,450,165 | B1 | * | 9/2002 | Silver et al. | 128/206.21 |
| 6,460,538 | B1 | * | 10/2002 | Kemp | 128/201.22 |
| 6,484,514 | B1 | | 11/2002 | Joseph et al. | |
| 6,513,516 | B1 | | 2/2003 | Sabin et al. | |
| 6,526,975 | B1 | * | 3/2003 | Chung | 128/206.14 |
| 6,602,213 | B1 | | 8/2003 | Figley | |
| 6,672,307 | B1 | * | 1/2004 | McDonald et al. | 128/207.11 |
| 6,694,972 | B1 | * | 2/2004 | Hetzel, Jr. | 128/201.22 |
| 6,701,919 | B1 | * | 3/2004 | Silver et al. | 128/201.22 |

* cited by examiner

ESCAPE HOOD

The present application is a continuation-in-part of U.S. patent application Ser. No. 10/244,714, filed Sep. 16, 2002, now U.S. Pat. No. 6,701,919, which is a continuation of U.S. patent application Ser. No. 09/383,675, filed Aug. 26, 1999, now U.S. Pat. No. 6,450,165.

FIELD OF THE INVENTION

The present invention relates to the field of escape hoods, and more particularly to single use-type emergency hoods to provide filtered air for breathing and vision during an evacuation.

BACKGROUND OF THE INVENTION

During fire emergencies, as well as chemical, biological, radioactive, and nuclear (CBRN) threats, it is critical to have breathable air and eye protection, in order to allow safe evacuation from a threatened region. While such events have an ordinary risk, recent terrorist threats have made the possibility and scope of such incidents far more visible.

During a mass evacuation, one generally plans for full, or even over-occupancy of a building. This presumption leads to a requirement for organized and easily deployed hoods.

Escape hoods typically have a single-use air filter which degrades over time. Therefore, the hoods may not remain in storage indefinitely. They must be activated prior to use to allow the normally-sealed air filter to contact fresh air.

Another limitation of escape hoods is that, during time of emergency, rapid deployment is essential.

An escape hood rack system is known from U.S. Pat. No. 6,450,165, expressly incorporated herein by reference. See also, U.S. Pat. Nos. 682,455, 3,500,033, 3,638,258, 3,895,625, 4,116,237, 4,173,220, 4,231,359, 4,236,514, 4,382,440, 4,627,431, 5,003,973, 5,113,527, 5,113,854, 5,119,808, 5,133,344, 5,146,636, 5,226,409, 5,283,911, 5,323,492, 5,367,706, 5,421,326, 5,431,156, 5,452,712, 5,483,956, 5,655,525, 5,690,095, 5,724,958, 5,820,530, 5,839,432, 5,875,775, 6,012,175, expressly incorporated herein by reference.

SUMMARY OF THE INVENTION

The present invention provides an escape hood and system for deployment thereof which allows for centralized organization and rapid deployment in case of emergency. Individual escape hoods are stored in a rack, in which used escape hoods cannot normally be reinserted, and for which management may be centralized. For example, all hoods in a rack may have a common expiration date, and therefore be replaced or refurbished together.

Ease of use is provided by automatically unsealing the filter during the act of removal from the rack. A handle is preferably provided to allow extraction of the hood from the rack by a simple pulling motion. The hood is preferably folded during storage, and automatically assumes working status after withdrawal. Therefore, a user need only pull the handle and then don the escape hood.

The rack preferably includes various electronics for facilitating centralized management and assisting users during emergency.

For example, the rack may have a self-illumination feature, for example activated manually, by extraction of a hood, through an interface with an external alarm or security system, or based on built in sensors, such as a smoke or fire detector. This illumination may be, for example, electrical or chemiluminescent. An electrical system advantageously includes a battery, such as a zinc-air cell, which when activated produces illumination for a period of hours. Chemiluminescent illumination systems are known, for example, from U.S. Pat. Nos. Re. 35,007, Re. 35,132, U.S. Pat. Nos. 3,597,362, 3,691,085, 3,704,231, 3,749,679, 3,775,366, 3,816,326, 3,888,786, 3,904,605, 3,940,604, 3,974,368, 4,064,428, 4,076,645, 4,186,426, 4,313,843, 4,379,320, 4,508,642, 4,626,383, 4,678,608, 4,698,183, 4,717,511, 4,751,616, 4,784,803, 4,950,588, 5,122,306, 5,158,349, 5,226,710, 5,232,635, 5,281,367, 5,294,377, 5,370,828, 5,390,086, 5,451,347, 5,484,556, 5,488,544, 5,508,893, 5,536,195, 5,543,524, 5,545,739, 5,552,968, 5,576,212, 5,597,517, 5,609,509, 5,650,099, 5,705,103, 5,824,242, 5,845,640, 5,931,383, 6,065,847, 6,106,129, 6,126,871, and 6,267,914, each of which is expressly incorporated herein by reference.

The rack preferably has audio and/or visual alerts, to assist persons in locating the rack, especially under emergency or impaired visibility conditions. For example, the rack may include a strobe, flashing light emitting diodes, or other visual alert. The rack may also have a siren or other audible signal producing device. These audio and/or visual alerts may be activated similarly to the above described illumination; however, preferably these are non-destructively testable during drills. Therefore, these may be powered by a rechargeable battery or long-lasting primary battery.

The rack preferably has sensor-monitoring of installed and removed hoods. That is, each hood may be electronically identified, either simply by serial number, or by salient characteristics, such as lot number, expiration date, type (if appropriate), and history (if appropriate). The rack can then provide management, for example producing a local or remote warning when an expiration date approaches for any hood contained. The rack can also store an event log, for example to monitor or detect tampering.

After a hood is removed, information may be stored and/or transmitted regarding the time and circumstances of removal. For example, this allows emergency services workers to estimate the number of persons who extracted hoods, allowing increased accountability. Further, if persons normally carry identification badges, these badges can be automatically tracked, for example optically or electromagnetically (e.g., RF-ID) read, to allow a determination of which person extracted at hood at a given time.

In cases of emergency, it may be appropriate to transmit security information over a physical line as well as wirelessly. Thus, the rack preferably supports both modes of communication.

While the use of the escape hood is in large part self-evident, the rack may provide written and/or audible instructions for use. Preferably, this information is available in multilingual form. Speech recognition may be used, for example, to determine the language of choice.

The rack may communicate directly with a central building security and alarm system, or to a remote service provider. For example, the service provider may provide off-site maintenance and monitoring of the rack and contents. Communication may be through one or more of a dedicated line, dial-up line, packet switched network, cellular communication, wireless communication, or the like.

Each escape hood may also include various electrical and/or electronic elements. For example, the hood may include a battery, for example an alkaline, lithium, zinc-air, or other type of primary cell. Since the escape hood is intended to be used once before disposal or refurbishing, the battery need not be rechargeable. Further, since the use of the escape hood will likely be limited to less than 12 hours, the cell need not have long usable life, although long shelf life is required, to the extent useful functions are implemented.

The hood may include illumination, for example a flashlight and/or LED illumination, so that in the event of power failure and/or smoke, vision is enhanced. Generally, this is a continuous beam facing forward. The hood may also have an alert illuminator, to allow others to find the user. This will typically be intermittent, and omni-directional. As discussed above, a chemiluminescent system may be provided for the escape hood, to provide a beacon to locate the wearer, and to provide useful illumination to facilitate egress. Photoluminescent materials may also be employed. Advantageously, the rack or storage system maintains such photoluminescent materials in an excited state, for example using an ultraviolet lamp, or the like.

The hood may also have a siren function, for example when the user requires assistance. This will generally be user-actuated or remotely actuated, since a continuous siren may be unnecessarily distracting and annoying.

The hood may include a radio frequency transponder and/or transmitter and/or receiver and/or transceiver system. In the case of a transponder (active or passive), the hood interacts with a remote system, which can provide identification and/or location information. Advantageously, if a user ID is provided when the hood is withdrawn from the rack, the user identification may be use as, or made a part of, the transponder signal.

In the case of a radio receiver, an audio and/or video signal may be provided to the wearer providing instructions for exiting or the like. In the case of a radio transmitter, in addition to transponder information (identity and/or location), the system may allow a wearer to communicate with rescuers, for example. In the case of a transceiver, interactive voice communications, e.g., walkie-talkie, full duplex, or cellular and/or picocell may be conducted. The hoods may also form a self-organizing ad hoc network to cooperate in sharing a communication band.

The hood itself may have an internal diagnostic system, for example to alert a potential wearer that the hood is past expiration, is exhausted or defective, or to provide other self-diagnostic information. For example, an air-quality detector may be provided after the filter, to detect degradation in performance.

The hood may also provide voice instructions for the user to prompt the user with relevant instructions. Some instructions may be preprogramming into the hood, or provided as a customized message. Advantageously, each rack is provided with location-sensitive customization information, which is conveyed to the hoods is houses. Likewise, when an alert is externally provided, the alert may be accompanies by a situation-specific programming for the hood. For example, fire alarm customization would be different than biological threat customization. A user interface, preferably speech recognition, is provided to control the prompts.

A heater may be provided for the optical window to prevent fogging. This heater may be electrically operated, or based on an exothermic chemical reaction, or both. For example, a battery typically gets warm while discharging due to chemical reactions and internal impedance. The battery heat may be used to warm the window. Likewise, a transparent resistive film is optionally provided on the window, powered by the battery.

Other types of electronic devices may, of course, be integrated within the hood. Typically, since the hood is rarely used, and when used, employed only to provide safe exit from a facility, expensive or non-cost effective features are not employed. However, such cost-related issues are not a limitation on the invention. Likewise, the escape hoods are typically sought to be compact for efficient storage and deployment. Therefore, large or bulky additions are not typically advantageous.

It is noted that, while the air filter is consumed during use, as would be a primary battery, the electronics module would probably be durable, and therefore suitable for reuse when the system is retrofitted.

The escape hood may also include a system for cooling air drawn through the filter for breathing, especially, for example, in case of fire. In this case, the hot air may harm the respiratory tissues of the wearer, or produce suboptimal results from the filter. (In other circumstances, the increased temperature is advantageous for the filter, especially if it comprises a catalyst for decomposition of toxic chemicals). The cooling system may be essentially of one of four types, which each cool the air drawn into or through the filter through a heat exchanger. First, a volatile refrigerant is allowed to vaporize, resulting in a withdrawal from the environment of a heat of vaporization. Examples of this type of refrigerant include hydro-chloro-fluorocarbon refrigerants, such as R-134a, and compressed carbon dioxide or dry ice. Second, an endothermic chemical reaction may take place. An example of this type of refrigeration includes the dissolution of ammonium nitrate in water. A third example is the facilitated evaporation of water, for example by solid sorption. For example, a zeolite has a high water absorption capacity, and, if separate from a liquid water supply, will produce a very low water vapor partial pressure in the gaseous space, causing the water to evaporate and cool. A fourth example is a Peltier junction cooler, for example driven by a battery. In some cases, battery discharge may be endothermic, and therefore this reaction may be employed both for cooling of air and powering of electrical components. A cylinder of compressed oxygen or compressed air may be provided, in which case the decompression of the air itself is endothermic. Such a system is considered a self-contained breathing apparatus, since the decompressed air would naturally be provided to the wearer for breathing. A closed cycle refrigeration system may also be employed; however, miniaturization of such systems is difficult, and given the limited duration of anticipated use, a consumable refrigeration system is preferred. See, U.S. Pat. Nos. 6,230,501, 6,409,746, 6,141,970, 6,103,280, 5,941,093, expressly incorporated herein by reference. See also, U.S. Pat. Nos. 6,602,213, 6,513,516, 6,484,514, 6,099,555, 6,036,004, 6,017,606, 5,967,308, 5,792,213, 5,603,729, 5,431,022, 5,261,241, 5,201,365, 4,986,076, 4,967,573, 4,920,963, 4,780,117, 4,751,119, 4,745,922, 4,427,010, 4,382,446, 4,081,256, 4,010,620, 3,977,202, 3,950,158, and 3,940,905, expressly incorporated herein by reference In general, release of gasses from a cooling system is not preferred, since these may reduce the environmental oxygen available for breathing. Thus, release of carbon dioxide or R-134a may pose an asphyxiation risk for the user.

A preferred air cooling system comprises an endothermic chemical reaction, such as dissolution of ammonium nitrate in water or an endothermic battery, or endothermic solid sorption.

The escape hood itself has a number of main physical attributes:

1. An air filter is provided to draw in external, presumably contaminated air, remove unsafe contaminants, and provide clean air for breathing.

2. A neck band is provided to seal the hood around the wearer's neck.

3. An impermeable shell is provided to cover the wearer's head.

4. A clear window in the impermeable shell is provided to provide generally unobstructed vision.

5. An exhaust valve is provided to vent exhaled air from the hood.

6. An integral handle may be provided to withdraw the hood from the rack.

7. A self-activation feature is preferably provided to activate the air filter upon removal from the rack, for example by releasing a seal or removing or puncturing packaging to expose the filter to the ambient air.

8. A self-expansion feature is preferably provided to expand the escape hood from a compact storage configuration to a normal expanded configuration, to facilitate proper use.

The escape hood is relatively simple to use. Unused hoods are arrayed in a rack, typically in a set of rows and columns. Each column is preferably situated such that both bottom and top are within arm's reach for a normal adult without undue stretching, climbing or stooping. The user places his fingers about a separate handle provided for each escape hood. Optionally, a release button, for example operated by thumb, is provided to release the drawer. The user withdraws the escape hood, which, at the time of withdrawal, is activated to expose the filter to the air, and to expand to normal size for use. The user then pulls the neck aperture over his or her head, and the system is ready for use.

Any electronics may be manually activated, or automatically activated during withdrawal. For example, a zinc air battery may be exposed to air in the same or a corresponding process to the activation of the air filter. Advantageously, a zinc air battery is present in a sealed compartment with the air filter, wherein the zinc air battery produces a low oxygen partial pressure within the compartment to help preserve the contents, acting similarly to a "getter".

The insertion and withdrawal mechanism is asymmetric, wherein a sealed, compact, unused escape hood may be inserted in a vacant slot without activation thereof, while withdrawal of the escape hood under normal conditions results in activation. A key or tool, or electronic interlock, or other method or device may be provided to permit service personnel to remove an escape hood without activation thereof. For example, a set of sharp blades are situated to slit a sealed package containing the escape hood during normal removal. A service tool may be provided to cover or retract the sharp blades, to allow removal without perforating the seal.

An electronic sensor or switch may be provided within the rack to activate rack-side electronics, and alert a central security system of the activation. For example, the release button may have an electrical sensor. Likewise, the presence or absence of an escape hood within a compartment of the rack may be sensed and reported. The sensing may be contact or non-contact. In one embodiment, during withdrawal, an optical bar code is read by an optical sensor, to both indicate activation and identify the withdrawn hood.

As stated above, in installations where typical users have identification badges, the badge may be read during hood withdrawal, for example using a video camera, scanner, or radio-frequency identification technology, to facilitate tracking of personnel. The escape hood may include a radio beacon transmitter and/or radio beacon receiver. In one embodiment, a geolocation system is implemented to allow rescue personnel to locate each escape hood, and presumably its wearer. For example, the escape hood may cooperate with a geographic positioning system (GPS) based tracking system. The escape hood may include a GPS receiver, and retransmit its determined location. Alternately, a network-based geolocation system, such as a type proposed for the US cellular E911 system, may be employed. In fact, it is not necessary that the escape hood decode its own location, but rather only to transmit information to that a remote system may locate it.

The present system supports an ancillary business method for monitoring and maintaining the racks. For example, in a large office building, a rack would be provided at least for each point of egress into a common area, and possibly within common areas. The number of hoods would generally be about the normal maximum occupancy of the facility, although in some cases an even larger number would be provided. This leads to a significant service and maintenance, as well as monitoring issue. This is especially the case where hoods are single use, and have individual expiration dates. Hoods may be consumed not only during emergencies, but also during drills, demonstrations, and system tests. While such service, maintenance and monitoring could be conducted internally to a facility by safety or security personnel, one aspect of the invention provides a centralized and/or off site facility for this purpose. The facility may be compensated on a service-contract basis, or on a per-use basis. Such a centralized facility offers the possibility of economies of scale, as well as centralized expertise. Further, by providing a remote centralized facility, local emergency workers may be relieved of the responsibility for handling escape hood elements of emergency evacuations.

Thus, especially where communications is provided to racks and/or escape hoods, a remote communications center may be provided to handle command and control of the hoods, as well as user interfacing. Therefore, according to one embodiment, each rack is equipped with a wireless communication system, communicating on one hand with a remote facility, and on the other hand as a base station for the plurality of escape hoods in the vicinity of the rack. Since the racks would be well dispersed throughout a building, each rack need only provide a relatively small communications cell to nearby hoods. The communications may use any available technology, but particularly preferred is FRS or GMRS, since transceivers are relatively inexpensive, are relatively low power, especially where short range only is required, these operate in an unlicensed or minimally restrictive licensed band, and these are suitable for voice communications.

Advantageously, the monitoring facility can not only respond to alarms produced by the rack, but also communicate alerts and alarms to the respective racks. For example, in case of a fire on one floor of a building, it may be prudent for those people on floors above the fire to carry with them escape hoods as they evacuate. Therefore, on the relevant racks, audio and/or visual alerts and messages may appear, instructing evacuees of the appropriate status. Likewise, in some instances, evacuees relatively distant from the threat may be instructed that use of the hood is unnecessary.

The implementation of complex rules for use is best left to trained professionals, and not to general security or emergency response workers who are less familiar with the installation and use of the racks and hoods.

On the other hand, the racks will typically be directly tied into the building alarm and security system, and cooperate directly therewith. Thus, in many buildings, smoke detectors are present. The rack need not have redundant smoke detectors, which reduces service issues and cost. This integration therefore allows the racks to communicate with a remote facility through a single or consolidated communications interface for a building or facility.

The maintenance and service components of the business provide for deployment and installation of the racks, replacement of expired, defective or used escape hoods, testing and auditing of deployed racks, monitoring of racks and usage thereof, and emergency services.

DETAILED DESCRIPTION OF THE PREFERRED EMBODIMENTS

Figure 1:
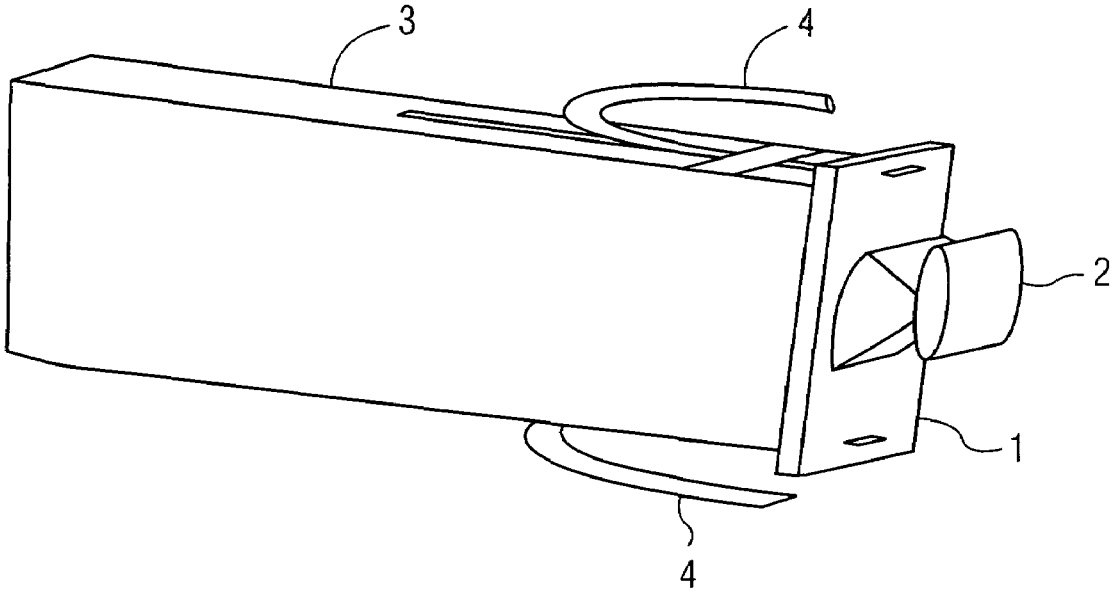
FIG. 1 shows a side perspective view of the escape hood according to the present invention, showing a drawer front and extraction handle, and the mask within a cubicle, with perforating hooks at top and bottom, prior to withdrawal.

In the figures, the same or similar components are indicated by the same or similar reference numerals in order to simplify and clarify the accompanying description.

The escape hood is preferably self-configuring after removal from the rack. Therefore, a resilient member is provided, which expands the hood to a usable state. It is preferred that the escape hood include a frame or framework, rather than be present as a flaccid bag. This is for two reasons. First, a structural framework assures that the window is properly aligned and spaced from the eyes and the exhaust vent is proximate to the mouth. Second, the framework makes the hood more comfortable. The frame may be formed of steel, or other spring material.

The self activation, upon hood extraction from the slot in the rack, may be implemented, for example, by a cutting edge which slices through a sealing structure around the escape hood during extraction. In this case, the cutting edges, which may be part of the rack, are retracted only during hood insertion, and rest safely spaced from the sealing structure during storage. The cutting edges may also be part of the hood assembly itself, rather than the rack. The cutting mechanism may, for example, have a locking point on the rack to activate the removal of the covering. Alternately, the hood (or air filter components thereof) may be sealed within a rigid housing having a sealing surface.

In a slightly different embodiment, the escape hood is provided as a rectangular prismatic package, containing a sealed hood, as well as the sealing structure release mechanism. The entire rectangular prismatic package is inserted into the rack, while during extraction, the outer casing is retained within the rack, while the unsealed hood is removed. In this case, the retaining clips for holding the structure within the rack may be integral with the unsealing mechanism.

The sealing structure is, for example, a metallized Mylar® (polyester) film or the like with low gas permeability.

In a preferred embodiment of the invention, the escape hood has a relatively rigid faceplate portion which encompasses a visor or window, respirator structure for covering the mouth and nose, filter, and exhaust valve, attached or hinged to a panel with the draw-handle. The rigid faceplate rotates to an upright and locked position at pivots, for example, left and right, formed with the panel. A set of elastic straps hold the faceplate portion in position by encircling the head. The hood structures, other than an expanding ring structure, are relatively flexible, encompassing the neck seal and head covering.

The hood is attached to the perimeter of the mask (faceplate), and has a neck portion formed of elastic Nomex® or a similar product. A self-adjusting belt which is attached to the hood, extends from the bottom of the mask, around the back of the neck, to fit the bottom of the hood against the neck.

The anterior surface of the faceplate has opening to accommodate nose and mouth of user. The opening contains a fixed mounted air bladder or any usable material, which will effectively create an airtight seal about the nose and mouth of said user. An airtight seal is established and maintained by a set of elastic straps or a head harness, which is fixed to the rigid faceplate. Attached to the upper edge of the "filter chamber" portion of the faceplate is a rigid transparent eye visor, which curves along the edge line of the faceplate. Attached to the lower portion of the rigid faceplate is an expanding ring, which expands and contracts by means of coiling on itself. This expanding ring opens and locks into position at the same time the faceplate pivots and locks. This lower ring may also be "U" shaped and bend inward.

Fashioned across the lower edge of the expanding ring is an elastic heat resistant material i.e. Nomex® (DuPont). This material surface has a circular opening in the center, which allows the user's head to extend therein. The material extends upwards from this circular opening, forming an inverted turtleneck. The end of this material is joined to the lower edge of the elastic strap.

Joined to the tipper edge of the visor, the outside edges of the faceplate, and the outer edge of the elastic heat resistant material (e.g., the Nomex® edge), is the outer protective hood. The outer protective hood is made of an impermeable high heat resistant material, i.e. aluminized and/or coated fabric, or a heat-resistant polymer film.

With this structure, the procedure for use is as follows. The elastic straps extending from the respirator portion of the faceplate are positioned behind the head, and the faceplate positioned over the mouth, nose and eyes. The straps tighten for fit and comfort. The remainder of the hood is then drawn over the head and neck, the self adjusting belt automatically tightening to reduce bagginess at the bottom of the hood.

The air filtration preferably meets, or exceeds, high government standards for escape hoods, e.g., European Standard EN 403 (1993) or EN 404 (1993), each of which is expressly incorporated herein by reference. Most preferably, the escape hood meets the requirements of EN 403 (1993).

There are different demands on a filter for protection against fire, smoke, chemical warfare agents, biological contamination, and radioactive particles. Likewise, for more general environmental threats, different filter characteristics may be required depending on the nature of the threat. The present system is not typically a self contained breathing apparatus (SCBA), and therefore does not have its own air supply. However, a number of general features may be employed to provide a broad range of protection. For example, chemical sorbents may be provided to remove reactive gasses, such as carbon monoxide, partial combustion products, free radicals, acids, bases, and the like, from the air. Activated carbon may be provided to remove various organic components. A catalytic bead filter (intrinsicly safe construction) may be provided to remove reducing gases. A micro-porous filter may remove various particulates, soot, bacteria and viruses.

Of these components, the catalytic bead filter is generally the most costly, and therefore may be optionally provided, depending on circumstances.

In a preferred design, the faceplate of the mask comprises interchangeable filter modules, for example for CBRN only, fire and smoke only, and a combination of smoke (including carbon monoxide), and CBRN.

A preferred design provides a matching set of filter cartridges, left and right, which "clip" into position, are replaceable, and are left/right interchangeable. Between the two filters, directly in front of the user's mouth, is the exhaust valve, which includes a unidirectional silicon rubber flap valve. This valve releases exhaled air to the outside of the hood, with a low release pressure.

The handle portion, may also contain a battery, such as a zinc-air battery. Such batteries have the characteristic of long shelf-life while inactivated, and high current capability and capacity after activation. Cost is relatively low, and usable life after activation is typically limited. The battery can be used to power any of the following, or a combination of items: Illumination source; Communication devices; Warning timers for filter life; Tracking device; Radio wave emitter; Electronic bar code/RF-ID; Sound location device; Instruction recording; Coolant (thermoelectric, subminiature Carnot cycle, etc.); and an Anti fog device The entire unit is folded and vacuumed sealed in a protective foil and/or film pouch. The handle portion of the escape hood assembly remains exposed, outside of the pouch. Surface mounted to the outside of the foil pouch are a set of clips, which engage the storage facility of the hood. As the hood is removed from its dormant state in the storage facility for use, the foil pouch is automatically torn away from the hood by the clips, releasing the hood for opening. The removal or perforation of the storage "pouch" may be accomplished by methods other than a clip, but it is preferred that any normal removal of the hood from the storage cubicle results in automatic activation of the escape hood, that is, conversion from a first mode adapted for long term storage, to a second mode adapted for protecting the wearer and/or filtering contaminants or toxins from the air FIG. 1 shows a side perspective view of the escape hood showing a drawer front 1 and extraction handle 2, and the mask within a cubicle 3, with perforating hooks 4 at top and bottom, prior to withdrawal.

Figure 2:
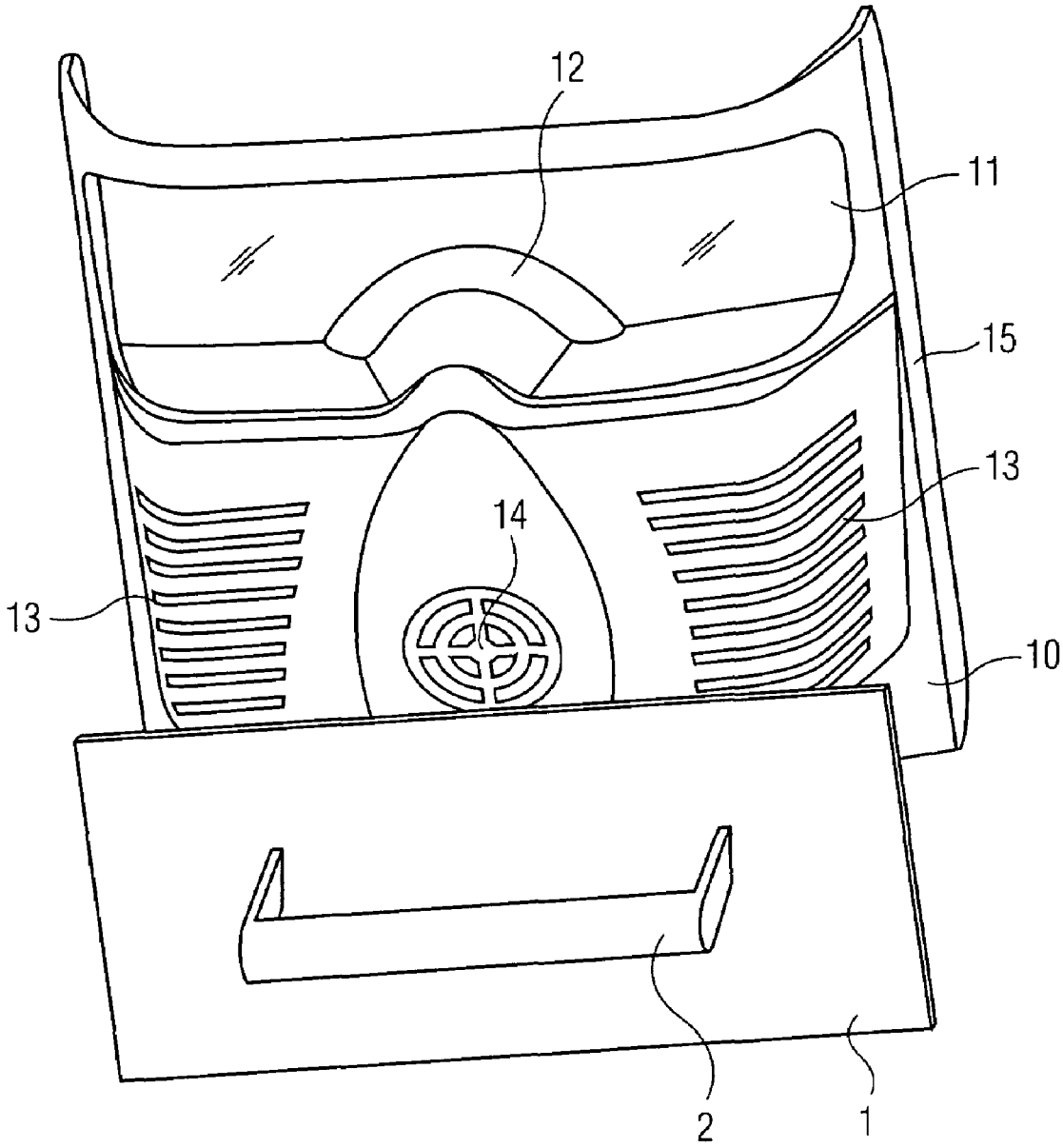
FIG. 2 shows a front perspective view of the escape hood according to the present invention, showing a drawer front and extraction handle, and the mask faceplate in the usage position, after withdrawal.

FIG. 2 shows a front perspective view of the escape hood, showing a drawer front 1 and extraction handle 2, and the mask faceplate 15 in the usage position, after withdrawal from the cubicle. The mask includes a pair of laterally disposed intake filters 13, a centrally located exhaust valve 14, a visor or window 11, and a respirator seal 12. The mask faceplate 15 is hinged to the drawer front 1, such that the surface 10 swings about 90 degrees with respect to the drawer front 1.

Figure 3A:
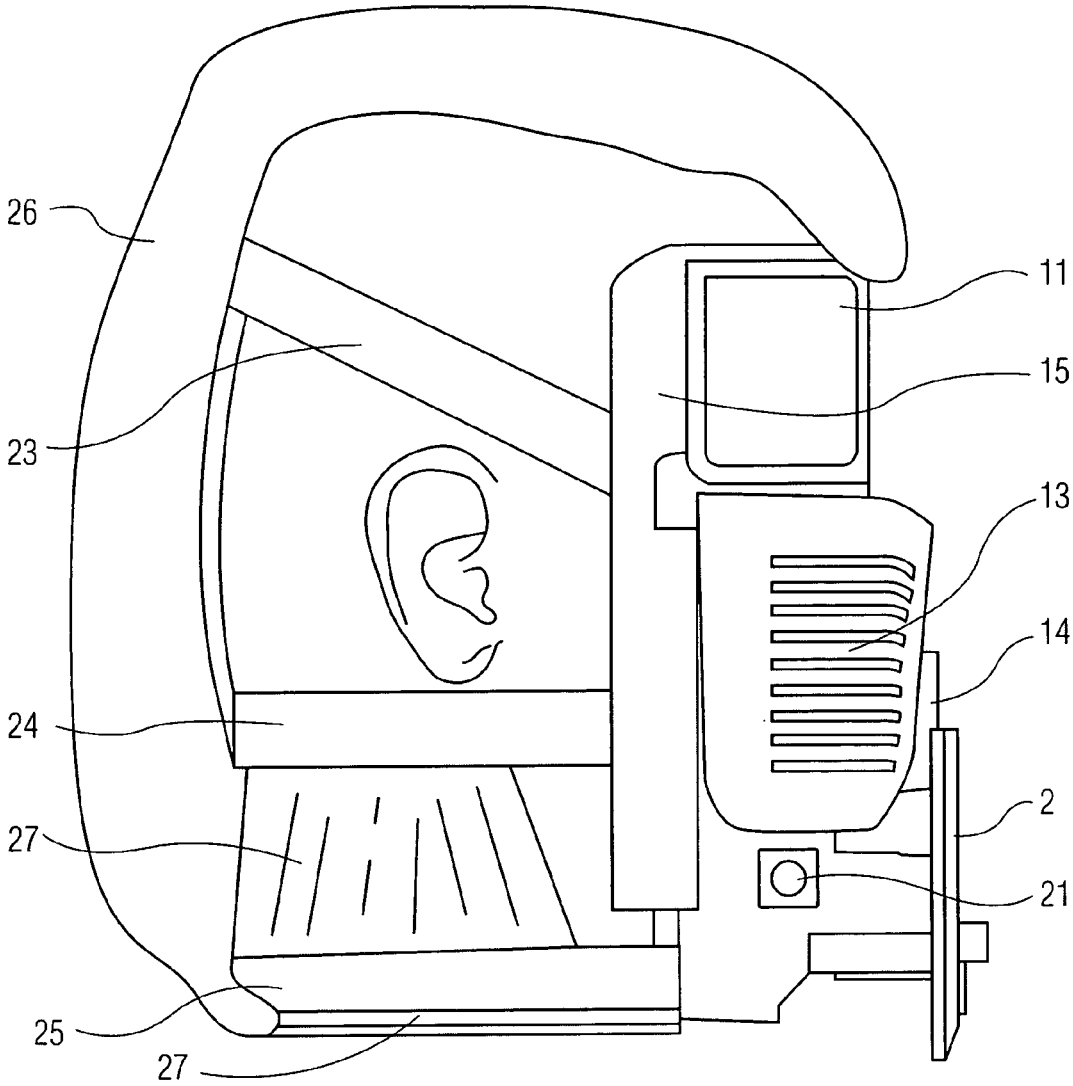
FIG. 3A shows a side view, of the escape hood according to the present invention on a wearer's head.
Figure 3B:
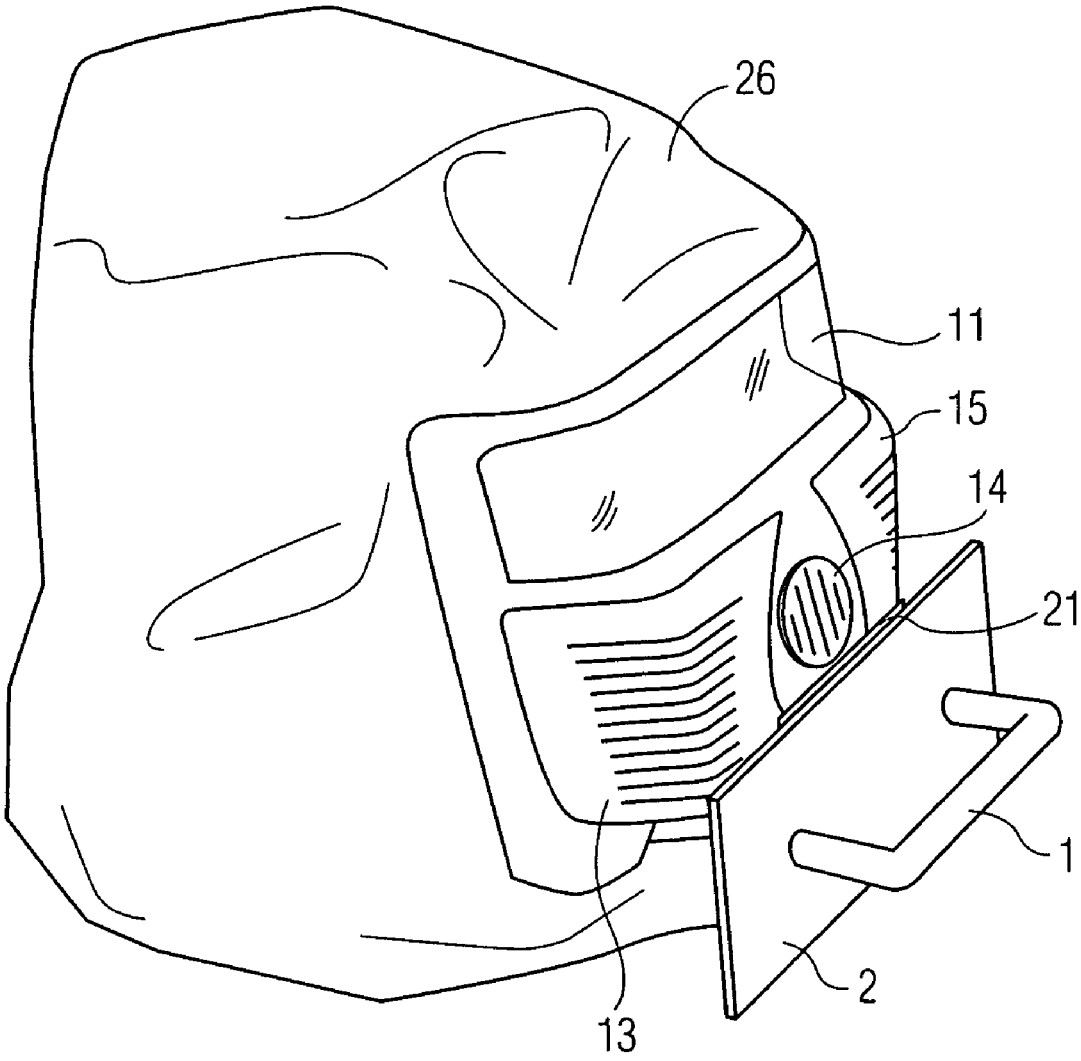
FIG. 3B shows a side perspective view of the mask and retaining strap portion of the escape hood according to the present invention, without the hood itself.

FIG. 3A shows a side view, of the escape hood on a wearer's head. This seal separates the respiratory air flows from the visual space, reducing the incidence of fogging of the window 11 lens. The mask is held in position by straps 23, 24, which encircle, respectively, the upper and lower portions of the wearer's head. A cushion 22 may be provided where the mask contacts the forehead. The edges of the mask faceplate 15 are connected to a flexible hood 26, which surrounds the wearer's entire head.

A self-adjusting, expanding ring 25, shown in more detail in FIG. 8, is optionally provided, which conforms the lower edge of the hood 26 against the wearer's neck. An elastic band 27 provides a comfortable seal, although it is not necessarily an air-tight seal. The self adjusting, expanding ring 25 comprises a flexible spring portion 25*a*, and may include, for example, a pair of retaining clamps 25*b* at the ends thereof. The retaining clamps 25*b* allow the flexible spring portion 25*a* to slide past the end to a desired position.

Figure 3C:
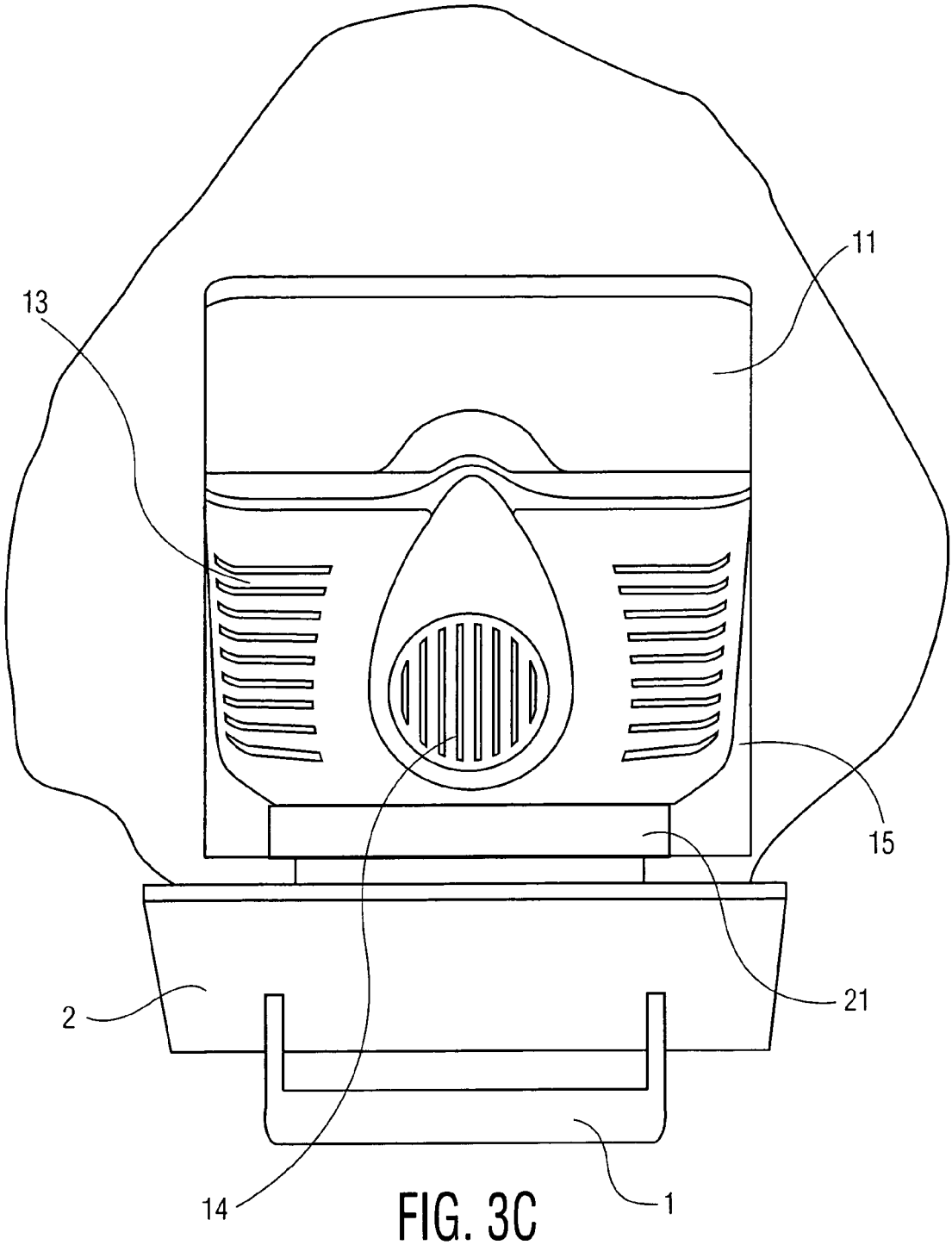
FIG. 3C shows a top perspective view of the mask and retaining strap portion of the escape hood according to the present invention, showing the mask folded into the storage position, after extraction from the rack and removal of sealing pouch.
Figure 4A:
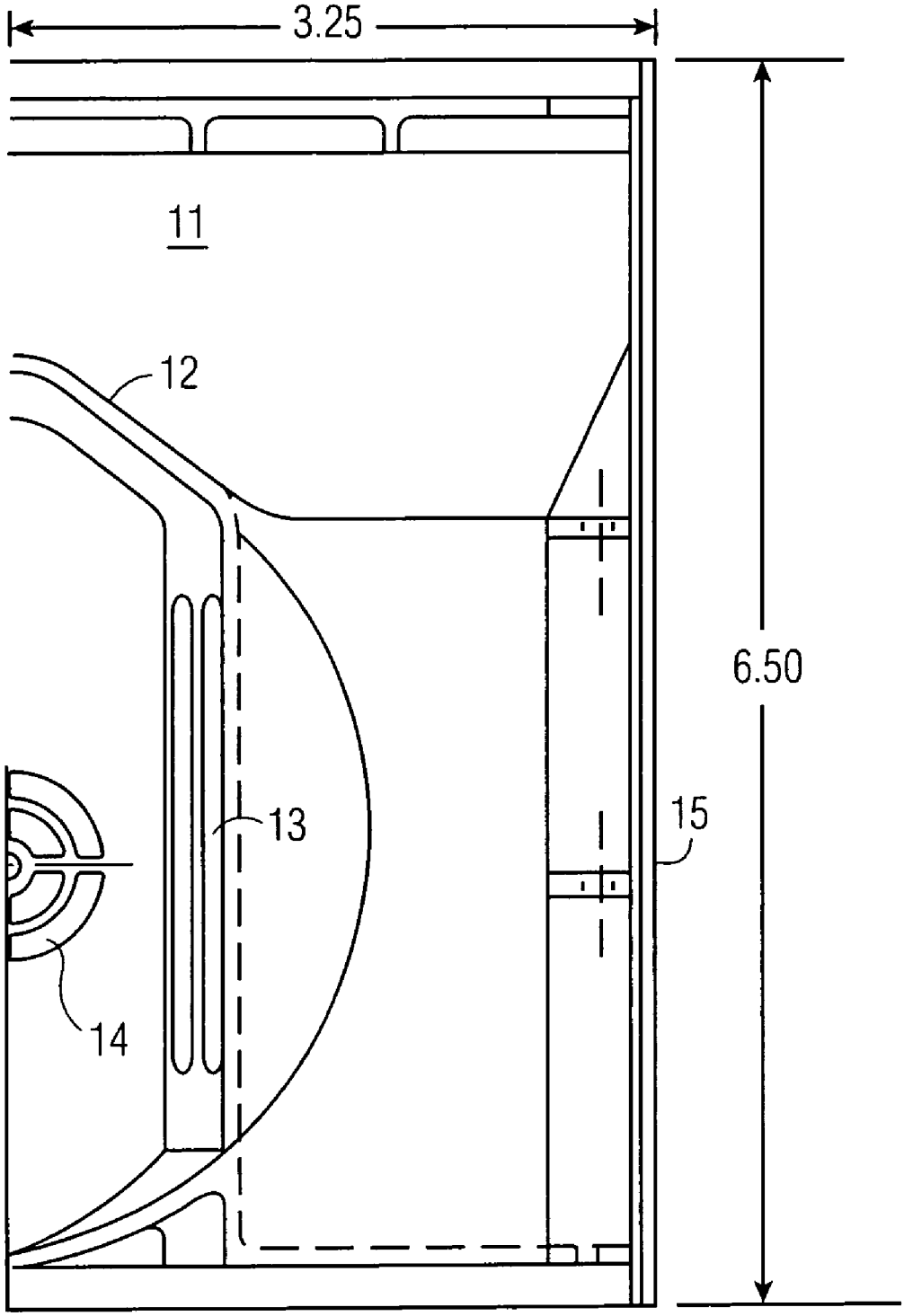
FIGS. 4A, 4B, 4C, and 4D, show, respectively, half-front (4A), half-top (4B), side view (4C) without extraction handle, and side view (4D) with extraction handle, respectively of the mask portion, absent the protective hood component.
Figure 4B:
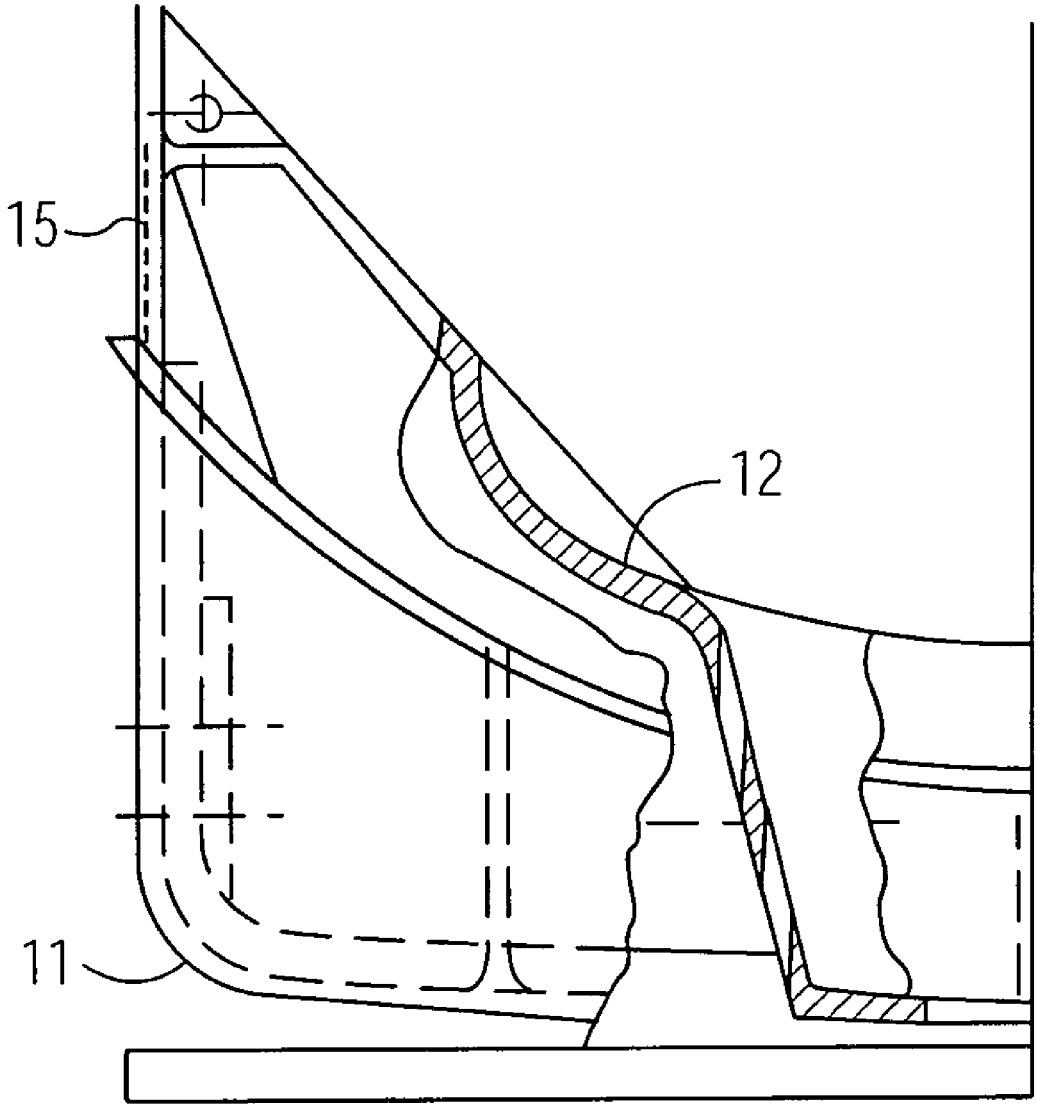
Figure 4C:
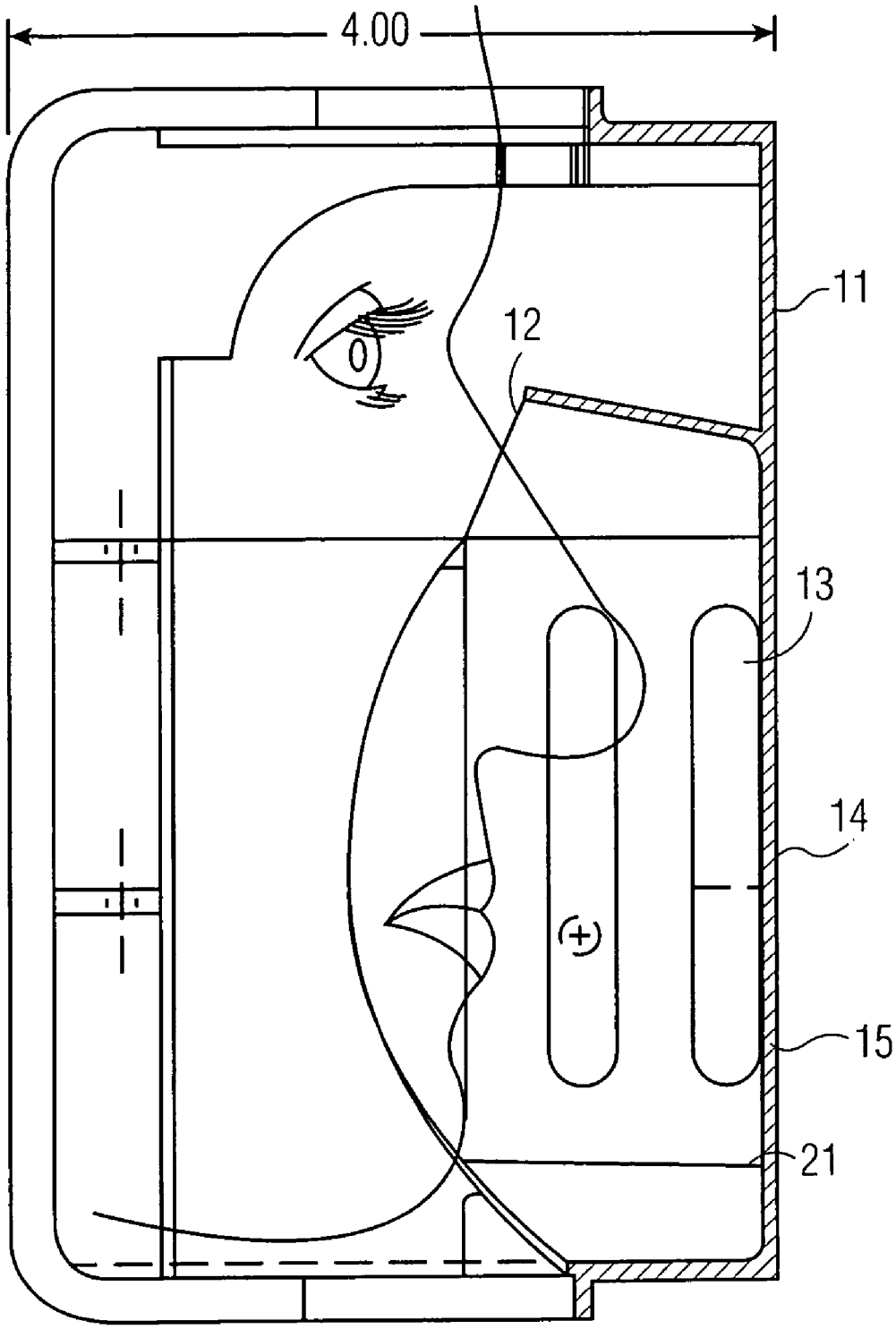
Figure 4D:
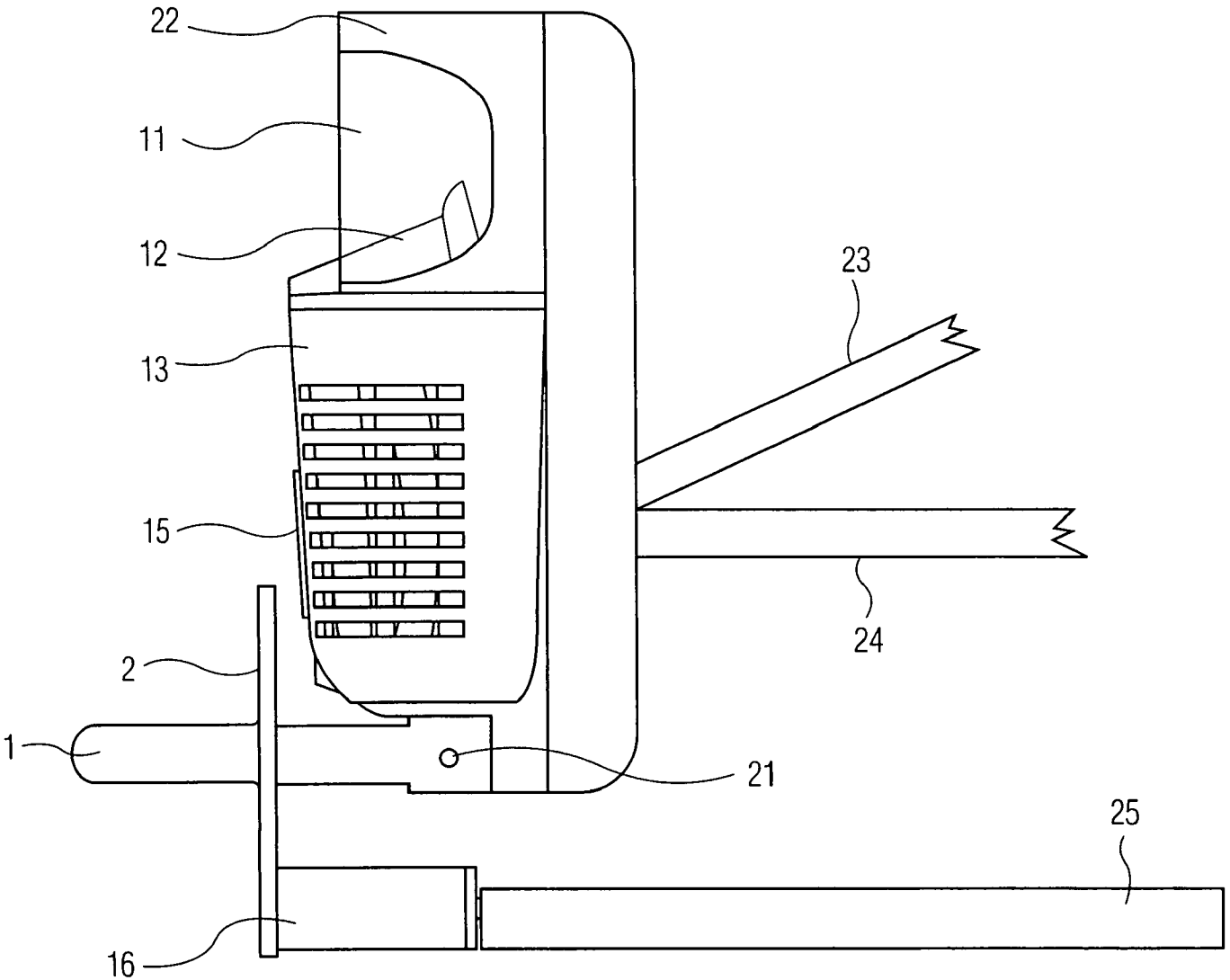

FIG. 3C shows a top perspective view of the mask, showing the mask faceplate 15 folded into the storage position, after extraction from the rack and removal of sealing pouch, with the mask faceplate 15 pivoted on the hinge 21 into the storage position. Typically, the mask is intended for only single use, and therefore a lock may be provided to prevent re-folding. FIG. 4D shows an alternate embodiment of the drawer faceplate 2, in which the hinge 21 is centrally located on the side panel 16, rather than at a junction corner, as shown in FIGS. 3A and 4C. FIGS. 4E–4H show further details of the mask faceplate 15 and filter module 13, 14.

Figure 5:
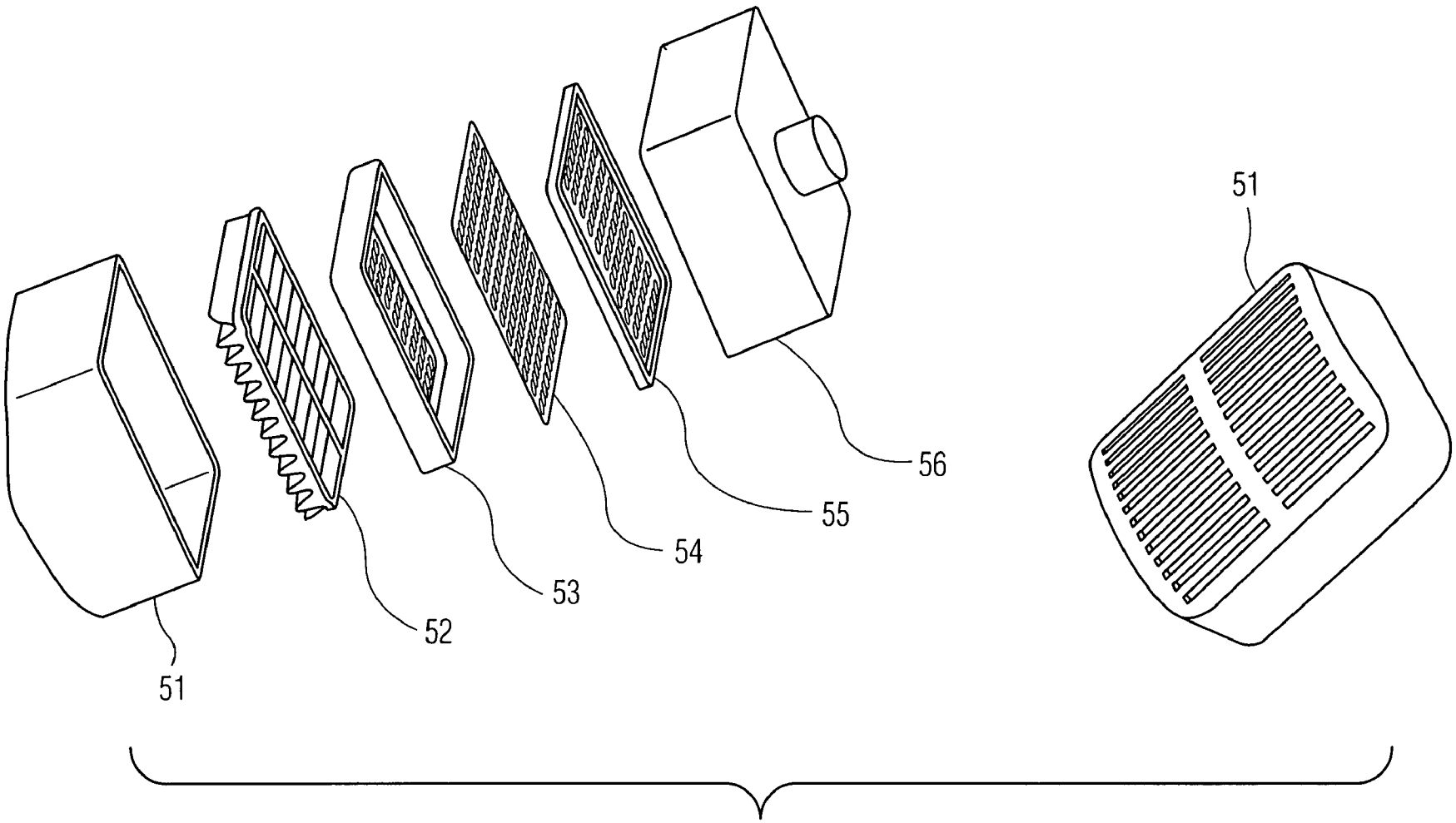
FIG. 5 shows an exploded view of an alternate filter module according to the present invention, showing its internal components and construction.

FIG. 5 shows an exploded view of an alternate filter module, showing its internal components and construction. This drawing shows that the filter components are sandwiched into a stacked array, and therefore that, within a common size filter housing, various filter components may be present. Thus, the rescue mask may be provided for different emergency conditions, although the filter will typically be manufactured with the mask. On the other hand, user-replaceable filters may be provided, and therefore a point-of-use option for interchangeable filters provided. As shown in FIG. 5, a filter cover 51 and cover filter 56 form the outer housing. Typically, these will be sealed together, for example by sonic welding, glue, or the like, to form an air-tight seal. A smoke filter 52 is provided on an under support panel 53, with an absorptive, catalytic, or detoxifying filter material (not shown) encased between the under support panel 53 and above support panel 55, with an intermediate filter support 54 provided therein.

Figure 6:
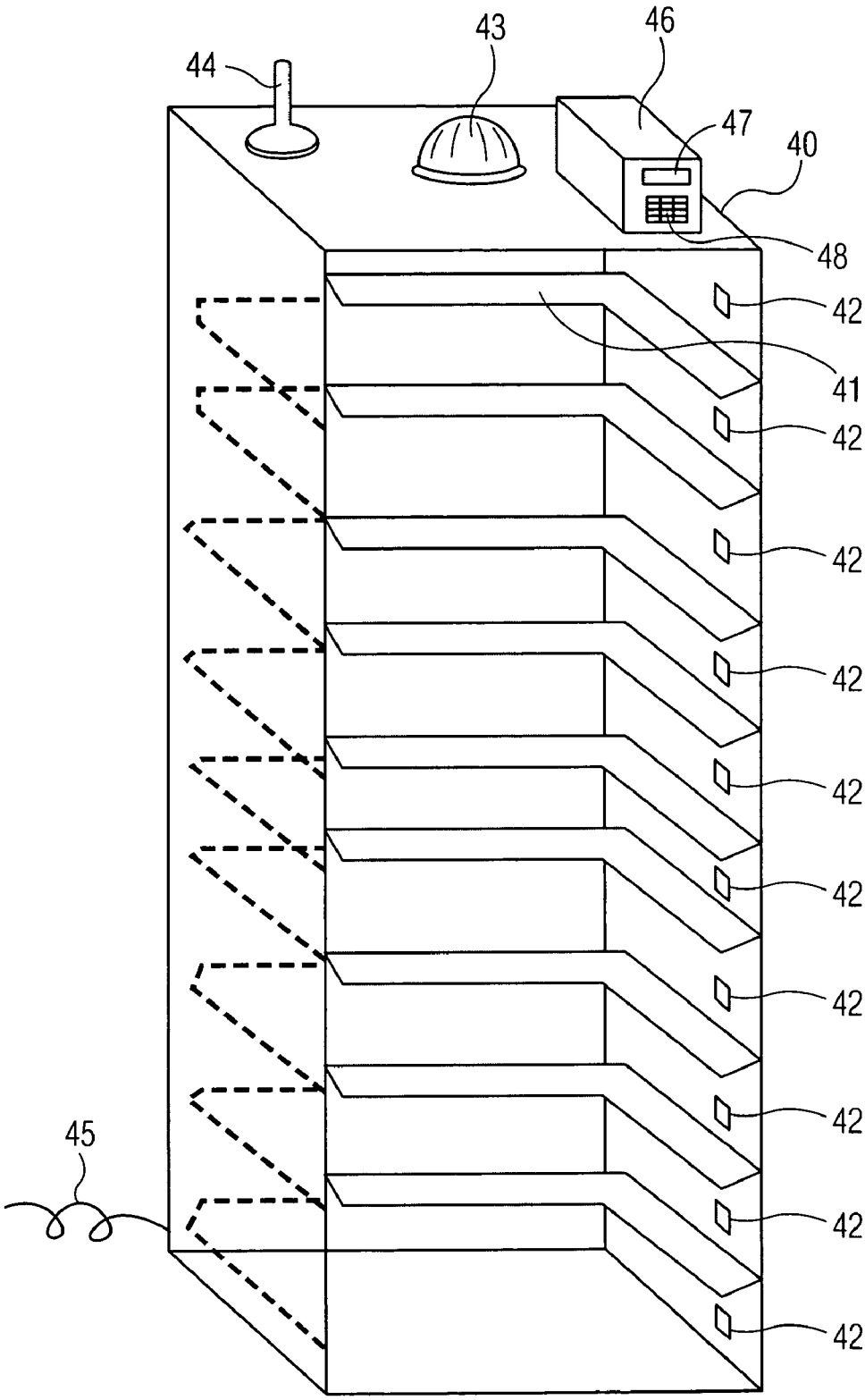
FIG. 6 shows a representation of a first embodiment of an unpopulated single column rack for storing a plurality of escape hoods.
Figure 7:
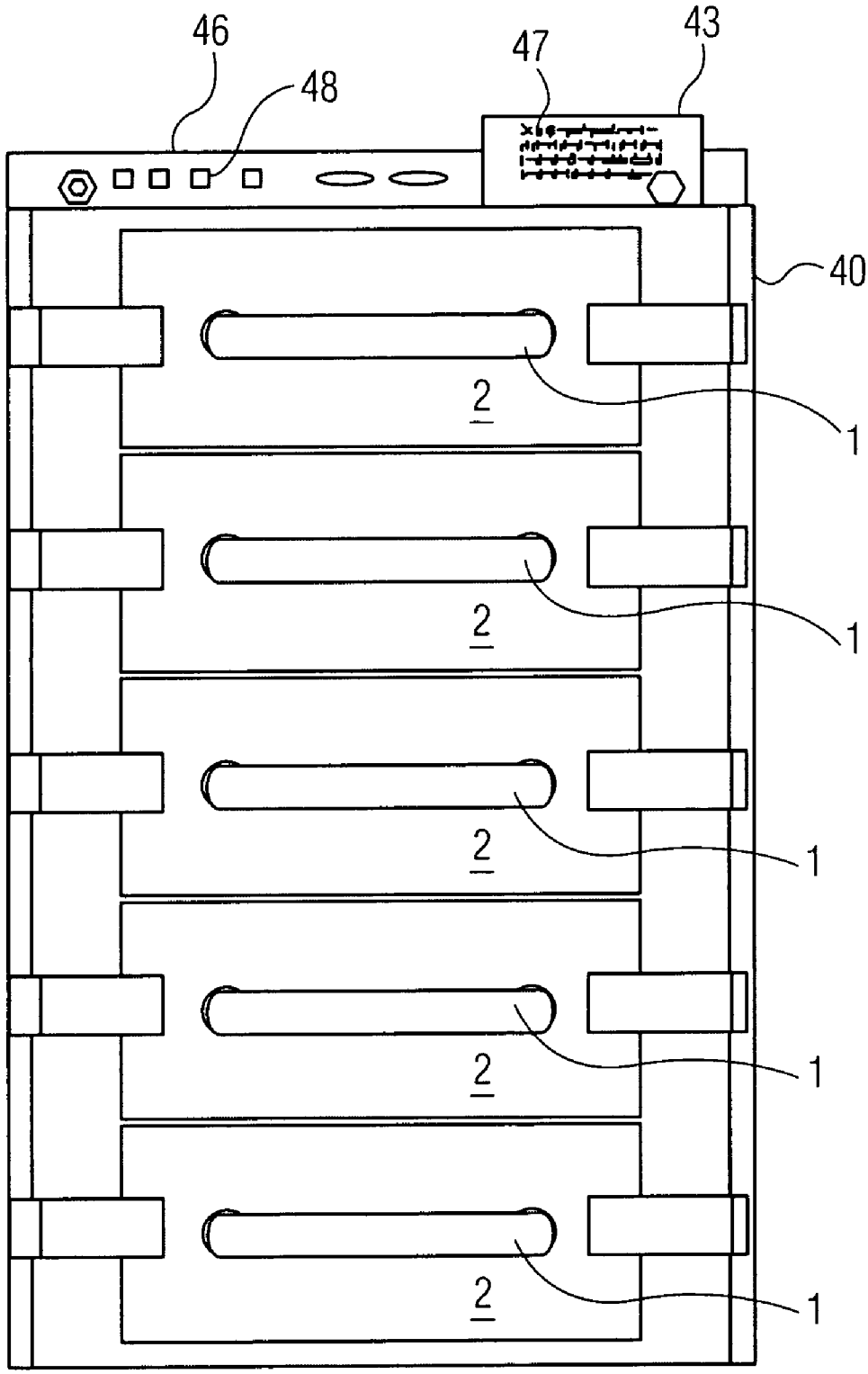
FIG. 7 shows a representation of a second embodiment of a populated single column rack for storing a plurality of escape hoods.
Figure 8A:
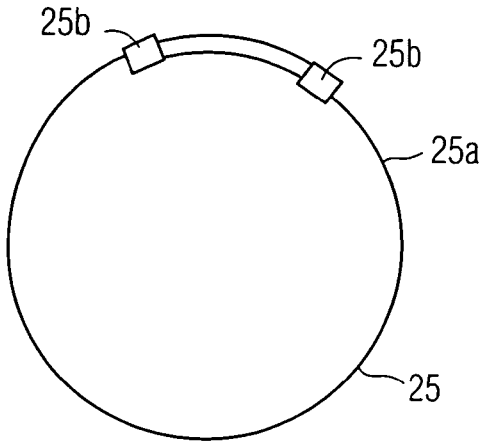
FIGS. 8A, 8B, 8C and 8D show top and perspective views of a self-adjusting neck-band for use in the escape hood according to the present invention.
Figure 8B:
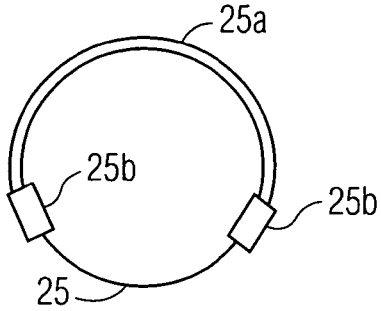
Figure 8C:
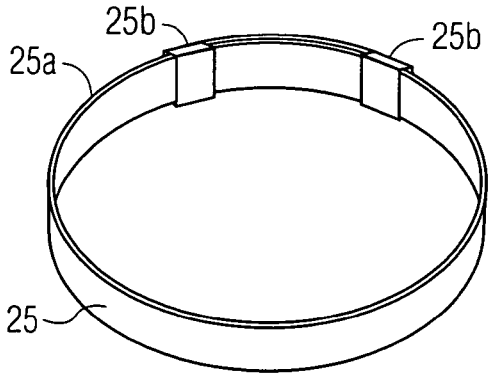
Figure 8D:
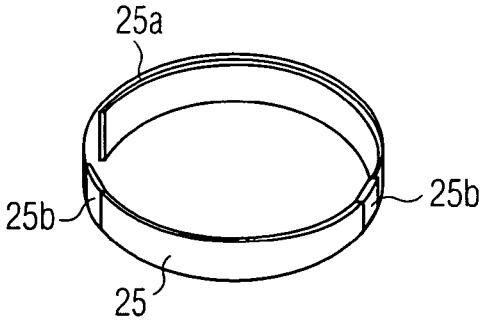

FIGS. 6 and 7 show, respectively, a representation of an unpopulated and a populated single column rack 40 for storing a plurality of escape hoods according to alternate embodiments of the invention. As shown in FIG. 6, a sensor 42 may be provided in each slot, to detect the presence or absence of a hood. The sensor may also be adapted for determining whether the hood has been unsealed, or, for example, has otherwise expired or become defective, and reject the hood. Therefore, if a hood has been unsealed, the sensor may detect the status of the hood, and prevent its insertion, thereby alerting that the hood should be replaced with a sealed or non-defective unit. Various electronics 43 (visual alert), 44 (RF antenna), 45 (wired connector, for example to supply power, or to communicate with external systems, such as a Fire Class E Command Center), 46 (a user interface, with display 47 and keypad 48), may be provided on the rack to provide means for communicating with a user, means for communicating with emergency personnel, and other control functions for the rack 40. The user interface may also include a biometric identification device.

The foregoing specification and drawings have thus described and illustrated a novel protective head enclosure which fulfills all the objects and advantages sought therefore. Many changes, modifications, variations and other uses and applications of the subject invention will, however, become apparent to those skilled in the art after considering this specification which discloses the preferred embodiments thereof. All such changes, modifications, variations and other uses and applications which do not depart from the spirit and scope of the invention are deemed to be covered by the invention, which is to be limited only by the claims which follow.

What is claimed is:

1. An escape hood, comprising:

(a) a respirator, having an air filter for filtering toxic ambient air contaminants and positioning members to retain the respirator in a respiratory path of a user;

(b) an optical lens;

(c) a expanding member, expanding said hood from a compact storage configuration to a usage configuration;

(d) a sealing structure, around said air filter, preserving said filter from contact with ambient air during storage; and (e) an unsealing mechanism, adapted to allow a user to withdraw the escape hood from a storage vessel, said sealing structure being automatically unsealed by said unsealing mechanism during withdrawal from said storage vessel to thereby permit contaminated ambient air to be filtered by said air filter for respiration by the user.

2. An escape hood system, comprising:

(a) an array of storage vessels, each vessel being adapted to receive a sealed escape hood;

(b) a retainer, for retaining a sealed escape hood within the vessel, wherein the escape hood is unsealed during withdrawal of the escape hood from a storage vessel;

(c) an electronic sensor for determining an occupancy of a storage vessel; and (d) a mechanism restricting insertion of an unsealed escape hood into a storage vessel.

3. The escape hood system according to claim 2, wherein said mechanism restricting insertion comprises means for restricting insertion of an unsealed escape hood in a storage vessel.

4. The escape hood system according to claim 2, further comprising a plurality of escape hoods each inserted respectively within a storage vessel.

5. The escape hood system according to claim 2, wherein each escape hood is sealed for storage, further comprising an automatic mechanism for unsealing each hood for use.

6. The escape hood system according to claim 2, wherein said array of storage vessels, or an escape hood stored therein, comprises an emergency illumination system, for illuminating a region proximate to the array under emergency conditions.

7. The escape hood system according to claim 2, wherein said array of storage vessels, or an escape hood stored therein, comprises an emergency sensor system, for detecting an emergency condition.

8. The escape hood system according to claim 2, wherein said array of storage vessels, or an escape hood stored therein, comprises an audio output device.

9. The escape hood system according to claim 2, wherein said array of storage vessels, or an escape hood stored therein, comprises an audio input device.

10. The escape hood system according to claim 2, wherein said array of storage vessels, or an escape hood stored therein, comprises a battery.

11. The escape hood system according to claim 2, wherein said electronic sensor for determining a presence of an escape hood in a storage vessel determines an identity of an escape hood stored in said storage vessel.

12. The escape hood system according to claim 2, wherein said array further comprises a data logger for electronically recording locally, or transmitting remotely, the occurrence of events.

13. The escape hood system according to claim 2, wherein said array further comprises an input for determining an identity of a person removing an escape hood.

14. The escape hood system according to claim 2, wherein said array comprises a radio frequency communication device.

15. The escape hood system according to claim 2, wherein an escape hood comprises an internal self-diagnostic system.

16. The escape hood system according to claim 2, wherein an escape hood is automatically activated for use upon removal from the array.

17. The escape hood system according to claim 2, wherein an escape hood comprises an air filter, sealed during storage, wherein said air filter is automatically unsealed upon removal from the array.

18. The escape hood system according to claim 2, wherein said mechanism restricting insertion of an unsealed escape hood in a storage vessel comprises an electronic element.

19. The escape hood system according to claim 2, wherein a plurality of arrays communicate electronically with a remote central system.

20. The escape hood system according to claim 2, wherein said retainer is electronically controlled to prevent unauthorized removal of an escape hood from said array.

21. The escape hood system according to claim 2, wherein an escape hood is sealed with a polymer film, said retainer being associated with a cutting edge to perforate said polymer film upon removal of said escape hood from said array.

22. The escape hood system according to claim 2, wherein an escape hood complies with EN 403.

23. The escape hood system according to claim 2, wherein an escape hood comprises an air filter, wherein said air filter is replaceable.

24. The escape hood according to claim 1, further comprising an output selected from the group of one or more of an electromagnetic energy emitter and an acoustic energy emitter.

* * * * *